United States Patent [19]

Martinez et al.

[11] Patent Number: 4,492,828

[45] Date of Patent: Jan. 8, 1985

[54] SLIDE SELECTOR SWITCH

[75] Inventors: Arthur T. Martinez; Richard B. Kilstofte, both of Long Beach, Calif.

[73] Assignee: T.A.D. Avanti, Inc., Compton, Calif.

[21] Appl. No.: 517,004

[22] Filed: Jul. 25, 1983

[51] Int. Cl.[3] ..... H01H 9/26

[52] U.S. Cl. ..... 200/5 R; 200/5 E; 200/16 B; 200/18; 200/159 R

[58] Field of Search ..... 200/5 R, 5 E, 5 A, 16 B, 200/18, 159 R, 340, 330, 331, 332, 335

[56] References Cited

U.S. PATENT DOCUMENTS

| | | | |
|---|---|---|---|
| 3,931,483 | 1/1976 | Thompson | 200/18 X |
| 4,100,384 | 7/1978 | Nishioka | 200/5 E X |
| 4,115,670 | 9/1978 | Chandler | 200/18 X |
| 4,358,646 | 11/1982 | Martinez | 200/5 R |

*Primary Examiner*—A. D. Pellinen

*Assistant Examiner*—Susan Steward

*Attorney, Agent, or Firm*—Keith D. Beecher

[57] ABSTRACT

A mechanical slide selector switch assembly for operating a series of pushbutton switches which includes an elongated support having a series of spaced parallel transverse members between which the switches are mounted, an elongated actuator slidably mounted on the support for reciprocal movement along the support, and a spring-loaded plunger mounted on the actuator to be moved across the transverse members from one switch to another to operate the switches as the actuator is moved to positions between successive pairs of the transverse members. When operating a switch the actuator is supported only by the switch and there is no contact between the actuator and the transverse members. However, when the actuator is moved off a switch it is supported by the transverse members until it engages the next switch.

7 Claims, 11 Drawing Figures

SLIDE SELECTOR SWITCH

BACKGROUND OF THE INVENTION

The slider selector switch of the invention is of the same general type as is described and claimed in U.S. Pat. No. 4,358,646 which was filed in the name of Arthur T. Martinez and which is assigned to the present assignee.

Like the selector switch assembly described in the Martinez patent, the selector switch assembly of the present invention finds particular utility in complex electrical and electronic systems, such as in telephone answering machines, in which a large number of switching contacts are to be operated as the switch is moved from one position to another, and in which it is imperative that only one set of contacts be operated at any one time.

The selector switch assembly of the invention is ideal for such uses since it is even more economical in its construction than the selector switch assembly described in the Martinez patent, since it is even easier to operate than the switch assembly described in the patent; since it requires a minimum of space; and since, like the switch assembly described in the Martinez patent, it is inherently mechanically interlocked because the plunger is capable of actuating only one of the pushbutton switches at any one time as it is moved from one position to the next on successive pairs of the transverse members.

DETAILED DESCRIPTION OF THE ILLUSTRATED EMBODIMENT

The mechanical selector switch of the invention is intended to operate selectively a series of pushbutton switches 10 which may be of the type, for example, described in U.S. Pat. No. 4,100,384 to Nishioka, and which is assigned to Matshita Electric Industrial Company of Japan. Each of the switches 10 includes an operating element 10*a* which is spring-biased to a first operating position, and which may be moved to a second operating position to perform a switching function.

Figures 3, 4, 5:
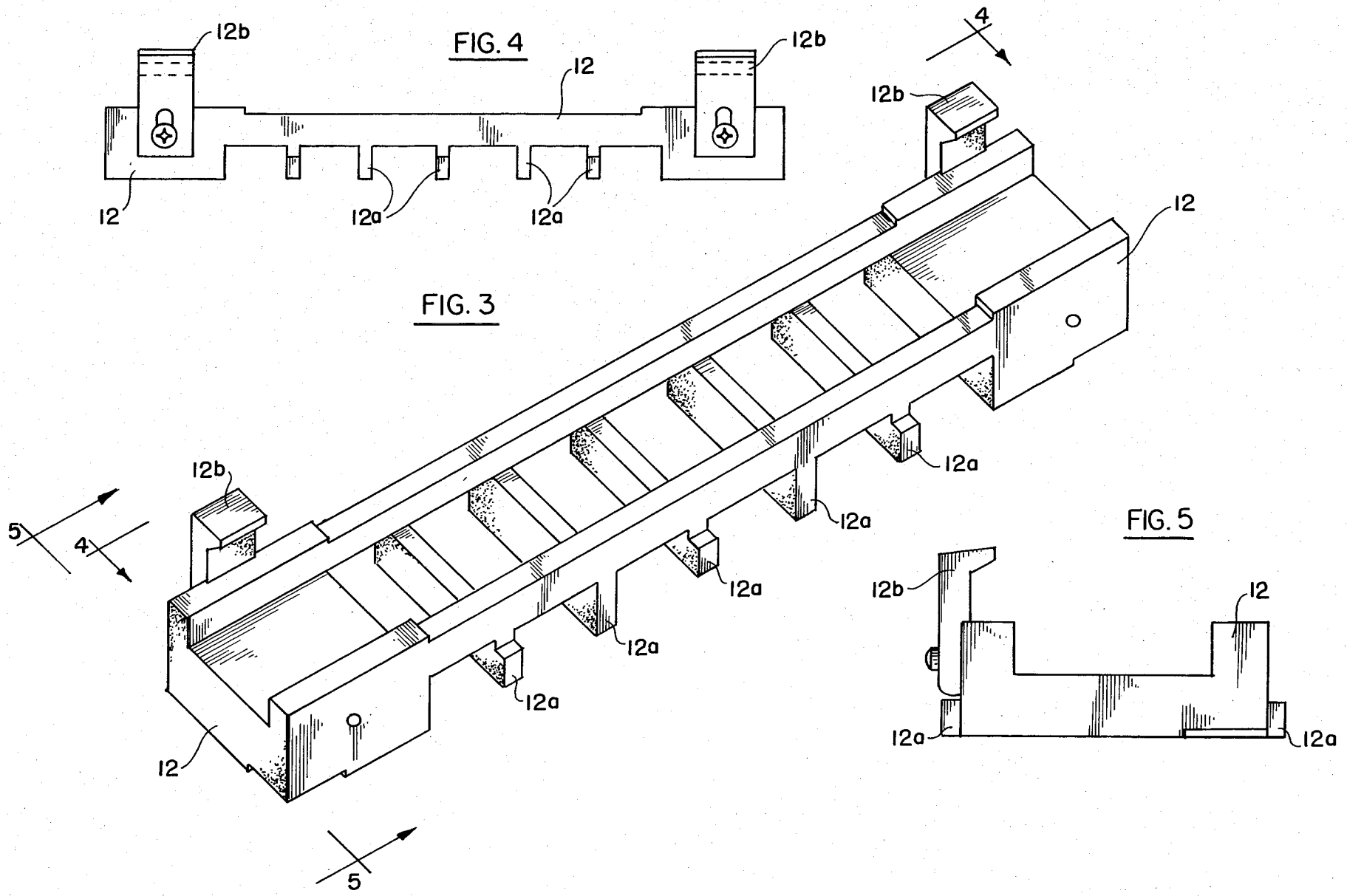
FIG. 3 is a perspective view of an elongated support which is included in the assembly of FIGS. 1 and 2.
FIG. 4 is a side view of the support of FIG. 3 taken along the lines 4—4 of FIG. 3.
FIG. 5 is an end view of the support of FIG. 3 taken along the lines 5—5 of FIG. 3.
Figure 7:
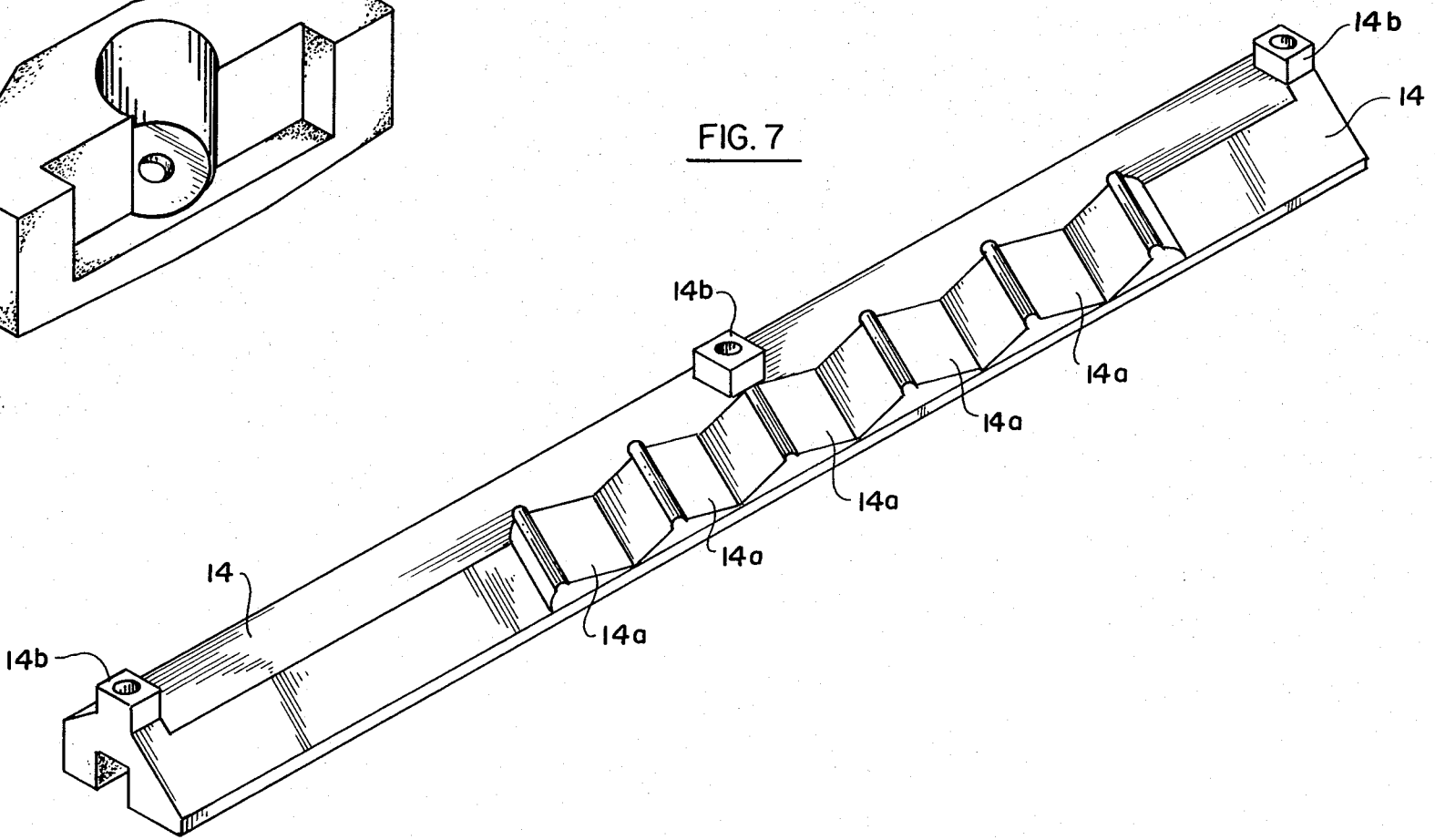
FIG. 7 is a perspective view of an elongated actuator which is included in the assembly, and which is slidably mounted on the support of FIG. 3 for reciprocal movement along the support.

The mechanical selector switch assembly of the invention includes an elongated support 12 (FIG. 3) which, for example, may be formed of an appropriate plastic material. The elongated support 12 includes a number of transverse members 12*a*. The support 12 is mounted over the switches 10 with the switches, in each instance, being positioned respectively between successive pairs of the transverse members 12*a*.

Figure 6:
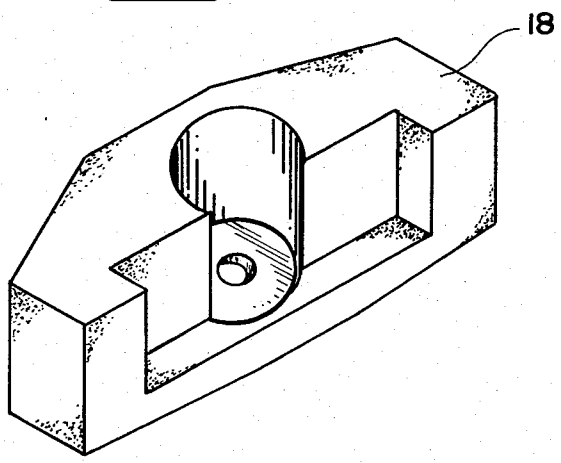
FIG. 6 is a perspective view of a plunger included in the assembly of FIG. 1.
Figure 11:
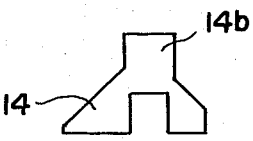
FIG. 8, 9, 10 and 11 are respectively top, elevation, bottom and end views respectively of the actuator of FIG. 7.
Figure 8:
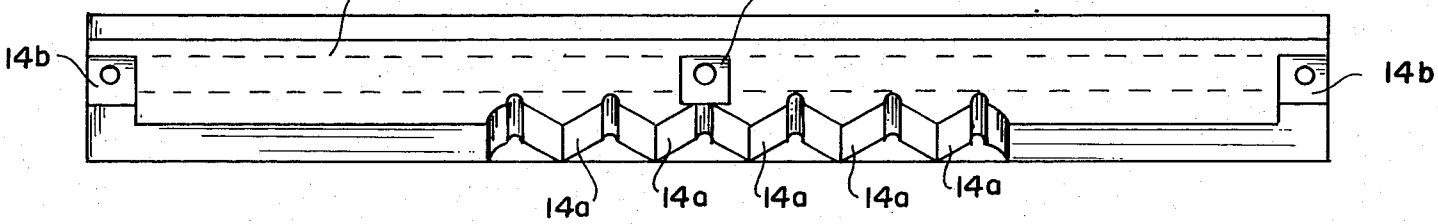
Figure 9:
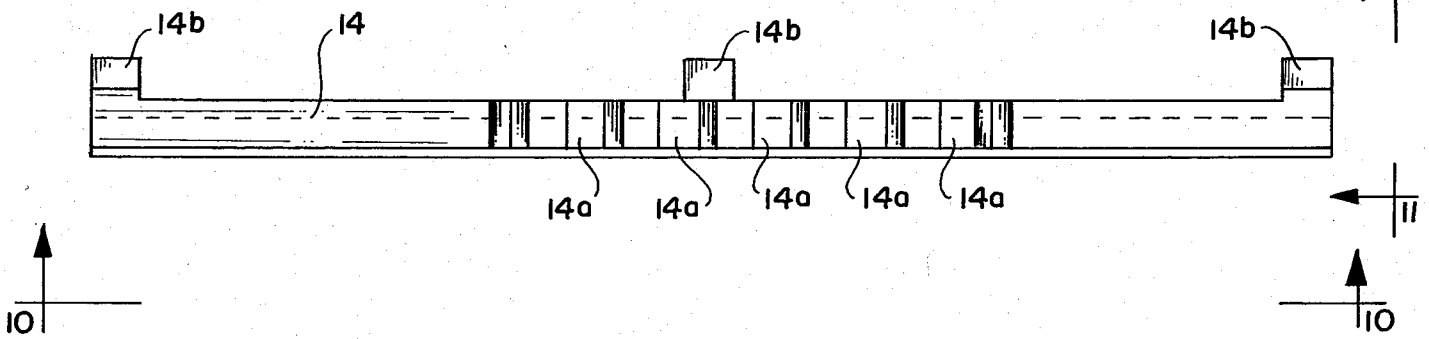
Figure 10:
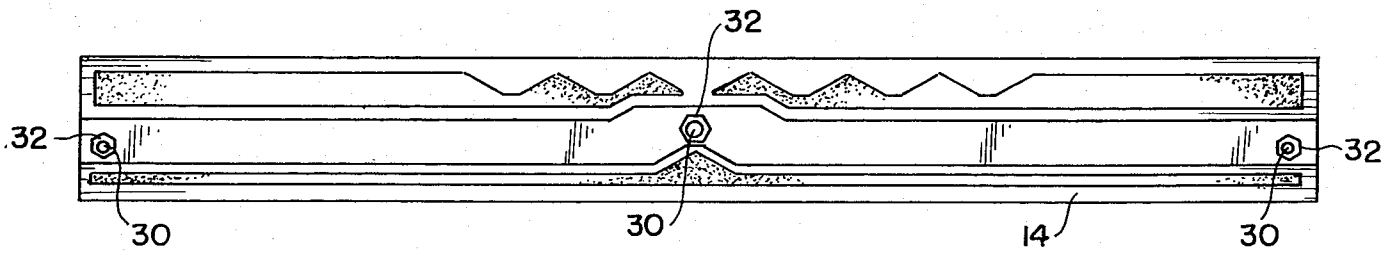

An elongated actuator 14 (FIGS. 7–11) is slidably mounted on the support 12 and is retained on the support by guides 12*b*. The actuator is reciprocally movable along the support. The actuator may be composed of any appropriate known self-lubricating plastic material. A plunger 18 (FIG. 6) is mounted on the underside of actuator 14, and is biased down against the successive pairs of transverse members 12*a*, and against the operating elements 10*a* of switches 10 by a spring 20. Plunger 18 may likewise be composed of an appropriate known self-lubricating plastic material.

As the actuator 14 is moved along the support 12, the plunger 18 moves from one pair of transverse members 12*a* to the next. The underside of the plunger 18 is tapered at each end, so that the plunger may easily be moved from one pair to the next of the transverse members 12*a*, and to engage the pushbutton switches 10. In each instance, when the plunger 18 is located between a particular pair of transverse members 12*a*, it biases the operating element 10*a* of the corresponding pushbutton switch to its second switching position. In this position the actuator is out of engagement with the transverse members.

A housing 22 (FIG. 2) formed, for example, from a mild steel sheet, is mounted over the elongated support 12 by means of a plurality of downwardly extending fingers, such as fingers 22*a* which frictionally engage the sides of support 12, and which are attached to base 23. A roller 24 is mounted on housing 22 by a resilient spring member 26. Actuator 14 has a series of detents 14*a* which are successively engaged by the roller to hold the actuator against slippage in each of its switch actuating positions.

Figure 1:
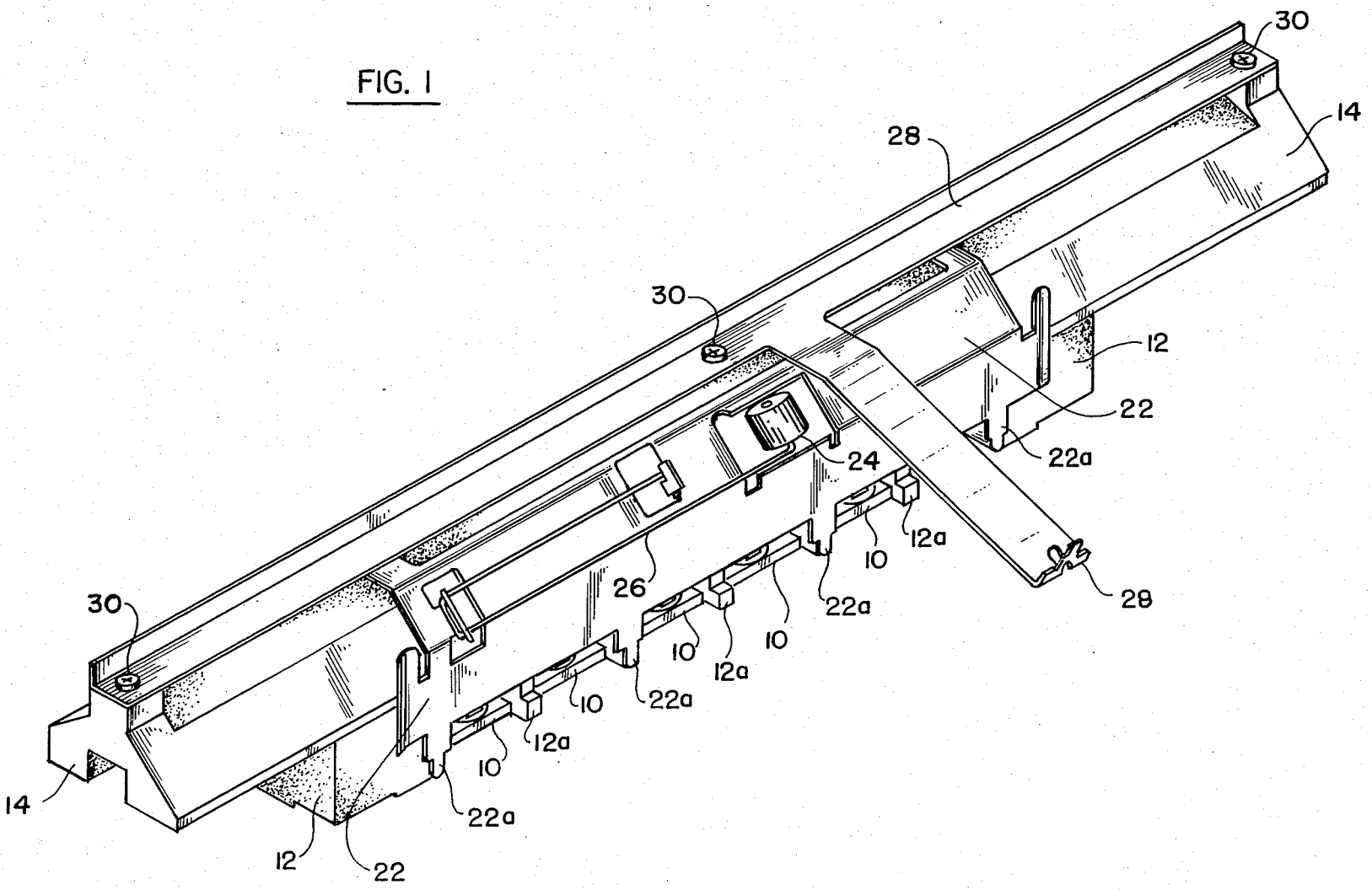
FIG. 1 is a perspective view of a mechanical selector switch assembly constructed in accordance with one embodiment of the invention.
Figure 2:
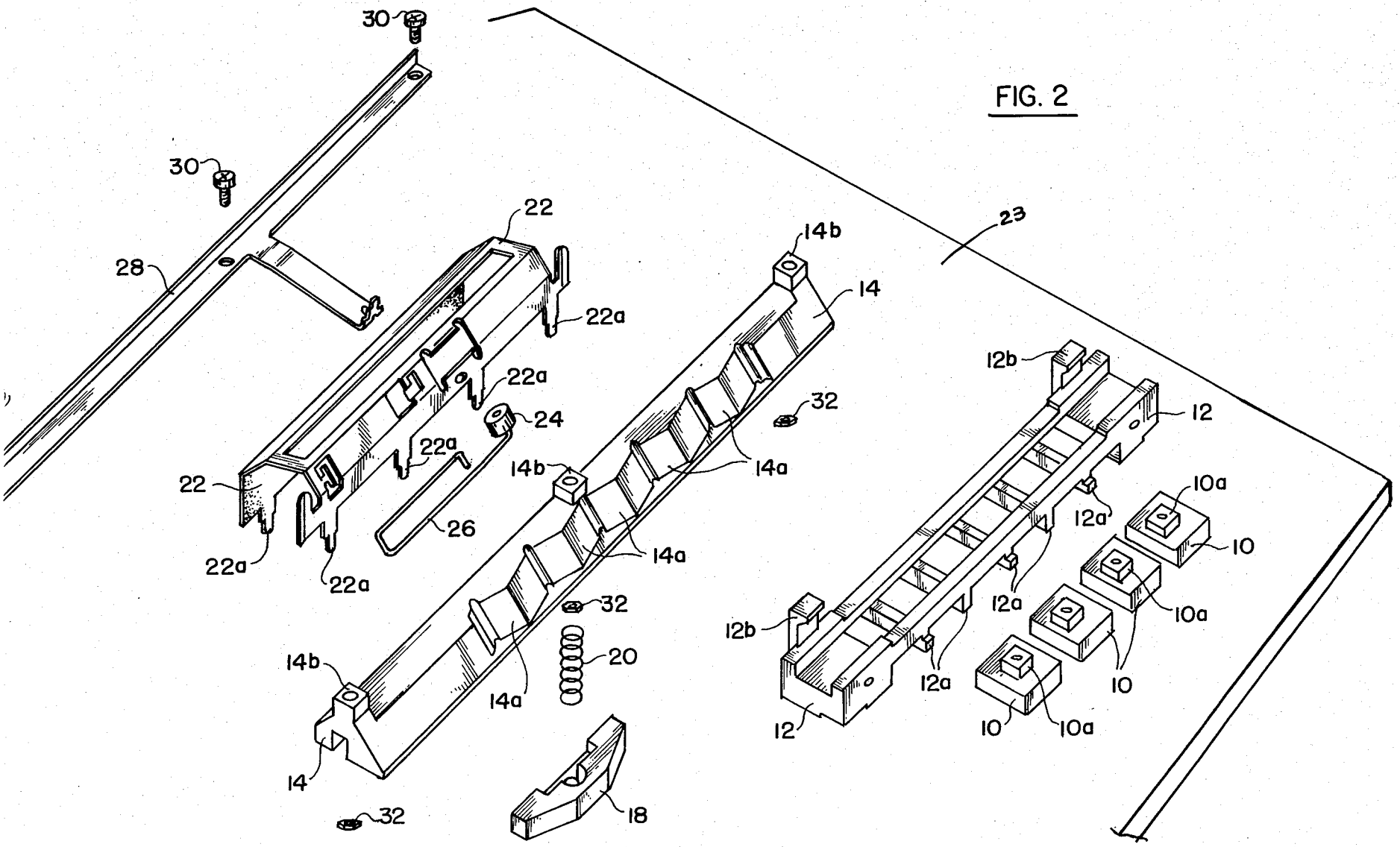
FIG. 2 is a perspective exploded view of the switch assembly of FIG. 1.

A linkage 28 (FIGS. 1 and 2) which, likewise, may be formed from a strip of mild steel is mounted on a number of upright posts 14*b* of the actuator 14. The linkage 28 is coupled to an appropriate drive means so that the actuator 14 may be moved back and forth along support 12 from one switching position to the next. The linkage 28 is mounted on the actuator 14 by screws 30 which are threaded into holes in the posts 14*b*, and which engage corresponding nuts 32 (FIG. 2). The posts 14*b* form stops for the switch assembly limiting the travel of actuator 14*b* along the support 12, as the stops engage the housing 22 at the limiting positions of the actuator.

The invention provides, therefore, a simple and inexpensive mechanical selector switch assembly in which an actuator may be easily and smoothly operated and moved from one detent position to another, while a spring-loaded plunger is moved from one pair of transverse members to another on a support, so that a series of pushbutton switches may be selectively operated.

It will be appreciated that while a particular embodiment of the invention has been shown and described, modifications may be made. It is intended in the claims to cover all modifications which come within the true spirit and scope of the invention.

What is claimed is:

1. A mechanical selector switch assembly for selectively operating a series of pushbutton switches, said pushbutton switches being mounted adjacent to one another and each including an operating element movable from a first position to a second position, said selector switch assembly including: an elongated support extending over the series of pushbutton switches and including a plurality of spaced and parallel transverse members extending between successive ones of the switches; an elongated actuator mounted on the support for reciprocal movement therealong, said actuator having a series of detents formed thereon; a plunger mounted on the underside of said actuator for movement thereby from between one pair of said parallel transverse members to another to move the operating element of a corresponding one of said pushbutton switches to its second position as the plunger is positioned between the corresponding pair of transverse members; an elongated housing mounted on said support and extending over said actuator; and a spring-biased roller mounted on said housing in position successively to engage said detents as the actuator is reciprocally moved along the support.

2. The mechanical selector switch assembly defined in claim 1, and which includes a spring for biasing said plunger down against the parallel transverse members and switch operating elements of the pushbutton switches.

3. The mechanical selector switch assembly defined in claim 2, in which the underside of the plunger is tapered at each end thereof to guide the plunger over the transverse members as the actuator is moved reciprocally along the support, and to permit the actuator to move the operating element of a corresponding one of the pushbutton switches when the plunger is positioned between a corresponding pair of the transverse members.

4. The mechanical selector switch assembly defined in claim 1, and which includes an elongated housing mounted on said support and extending over the actuator, and in which the actuator has stops formed thereon which engage the housing to limit the movement of the actuator along the support in both directions.

5. The mechanical selector switch assembly defined in claim 1, and which includes a linkage mounted on said actuator for moving the actuator reciprocally along the support.

6. The mechanical selector switch assembly defined in claim 1, in which the actuator is slidably mounted on the support.

7. The mechanical selector switch assembly defined in claim 1, in which the support and the actuator member are formed of a self-lubricating plastic material.

* * * * *